US010359049B2

(12) United States Patent
Qiu et al.

(10) Patent No.: US 10,359,049 B2
(45) Date of Patent: Jul. 23, 2019

(54) IMPELLER BLADES STRUCTURE AND ROTOR ASSEMBLY USING SAME

(71) Applicant: ASIA VITAL COMPONENTS CO., LTD., New Taipei (TW)

(72) Inventors: Junchun Qiu, New Taipei (TW); Jianwu Yin, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 101 days.

(21) Appl. No.: 15/795,274

(22) Filed: Oct. 27, 2017

(65) Prior Publication Data

US 2019/0128276 A1 May 2, 2019

(51) Int. Cl.

| | |
|---|---|
| ***F04D 29/22*** | (2006.01) |
| ***F04D 1/00*** | (2006.01) |
| ***F04D 29/66*** | (2006.01) |

(52) U.S. Cl.

CPC ..... *F04D 29/2216* (2013.01); *F04D 1/00* (2013.01); *F04D 29/2222* (2013.01); *F04D 29/66* (2013.01)

(58) Field of Classification Search

CPC ..... F04D 29/2216; F04D 29/2222; F04D 29/242; F04D 29/245; F04D 29/24

USPC ..... 416/223, 183

See application file for complete search history.

(56) References Cited

FOREIGN PATENT DOCUMENTS

WO WO-2018153350 A1 * 8/2018

OTHER PUBLICATIONS

WO-2018153350-A1 EPO Machine Translation. Accessed EPO website on Apr. 5, 2018. 12 Pages. (Year: 2018).*

* cited by examiner

*Primary Examiner* — Richard A Edgar

(74) *Attorney, Agent, or Firm* — Jackson IPG PLLC; Demian K. Jackson

(57) ABSTRACT

An impeller blade structure includes a main body having a first through opening communicating a first side with an opposite second side of the main body. The main body is formed on the first side with angularly spaced block-like blades, which respectively include a first end contacting or not contacting with the first through opening, an opposite second end, and a first coupling section. Any two adjacent blades together define between them a passage. When a virtual line tangentially passes through a point on a circumference of the main body that is corresponding to one radially outer end of the blade, an acute included angle will be defined between the virtual line and the blade. With these arrangements, the blades produce less noise and are more durable for use when the impeller blade structure rotates. A rotor assembly including the impeller blade structure is also disclosed.

16 Claims, 14 Drawing Sheets

IMPELLER BLADES STRUCTURE AND ROTOR ASSEMBLY USING SAME

FIELD OF THE INVENTION

The present invention relates to an impeller blade structure and a rotor assembly using same, and more particularly, to an impeller blade structure and a rotor assembly using same that produce less noise during operation and are more durable for use.

BACKGROUND OF THE INVENTION

A commonly known pump includes a chamber provided with two through openings, via which the chamber is communicable with an external environment and a fluid can flow into and out of the chamber. An impeller is a rotary member arranged in the chamber of the pump. When the impeller rotates, it produces a centrifugal force and a change of pressure in the pump chamber. As a result, the fluid is sucked into the chamber via one of the two through openings and then discharged from the chamber via the other through opening. In this manner, the pump can achieve the purpose of pumping and delivering the fluid.

Conventionally, the blades formed on the impeller are respectively in the form of a thin plate. To prevent portions of each blade near two lateral sides of a radially outer end thereof from interfering with an inner wall surface of the pump chamber, the outer end of each blade is designed to have a largely reduced thickness than other portions of the blade and accordingly, has a relatively sharp edge. The radially outer ends of the impeller blades with relatively sharp edges tend to oscillate when they are subjected to a force applied thereto by the fluid flowing through the pump. As a result, a relatively large noise is produced when the pump operates. Further, local thermal stress tends to occur at the oscillated outer ends of the blades to speed up material fatigue at the blade outer ends and shorten the service life of the blades.

It is therefore tried by the inventor to develop an improved impeller blade structure to solve the problems and disadvantages of the prior art impeller for pump.

SUMMARY OF THE INVENTION

To effectively solve the disadvantages of the prior art impeller for pump, it is a primary object of the present invention to provide an impeller blade structure, of which the blades won't oscillate at their radially outer ends to thereby produce less noise and have elongated service life. It is also an object of the present invention to provide a rotor assembly using this impeller blade structure.

To achieve the above and other objects, the impeller blade structure according to the present invention includes a main body having a first side and an opposite second side and being formed with a first through opening, which communicates the first side with the second side. The main body includes a plurality of blades formed on the first side, and the blades respectively includes a first end, which can be in contact with or not in contact with a peripheral edge of the first through opening, and a second end, which is located opposite to the first end. The blades further respectively include a first coupling section, and have a first edge, a second edge and a third edge. The first and the second edge of each of the blades are spaced from each other and extended from the second end toward the first through opening, and the third edge is located at the first end with two opposite ends connected to the first and the second edge, such that the first, the second and the third edge together define a top surface of the blade. A radially outer end of the second edge is located corresponding to a point on a circumferential edge of the main body, such that a virtual line tangentially passes through the point and the second edge together define an included angle between them. Any two adjacent blades together define between them a passage. A section of each of the passages located adjacent to the third edge of a corresponding blade forms a narrowed passage, and another section of the passage located adjacent to the second edge of the corresponding blade forms a flared passage.

To achieve the above and other objects, the rotor assembly according to the present invention includes an impeller blade structure and a rotor structure. The impeller blade structure includes a main body having a first side and an opposite second side, and being formed with a first through opening, which communicates the first side with the second side. The main body includes a plurality of blades formed on the first side, and the blades respectively includes a first end, which can be in contact with or not in contact with a peripheral edge of the first through opening, and a second end, which is located opposite to the first end. The blades further respectively include a first coupling section, and have a first edge, a second edge and a third edge. The first and the second edge of each of the blades are spaced from each other and extended from the second end toward the first through opening, and the third edge is located at the first end with two opposite ends connected to the first and the second edge, such that the first, the second and the third edge together define a top surface of the blade. A radially outer end of the second edge is located corresponding to a point on a circumferential edge of the main body, such that a virtual line tangentially passes through the point and the second edge together define an included angle between them. Any two adjacent blades together define between them a passage. A section of each of the passages located adjacent to the third edge of a corresponding blade forms a narrowed passage, and another section of the passage located adjacent to the second edge of the corresponding blade forms a flared passage. The rotor structure includes a body portion having a third side and an opposite fourth side. The third side is facing toward the first side of the main body of the impeller blade structure and has a plurality of second coupling sections angularly spaced thereon to correspondingly engage with the first coupling sections.

With the arrangements of the present invention, the radially outer ends of the blades won't oscillate and no local thermal stress will occur on the blades when the impeller blade structure and the rotor assembly rotate. Therefore, the impeller blade structure and the rotor assembly of the present invention can operate with reduced noise and have extended service life.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
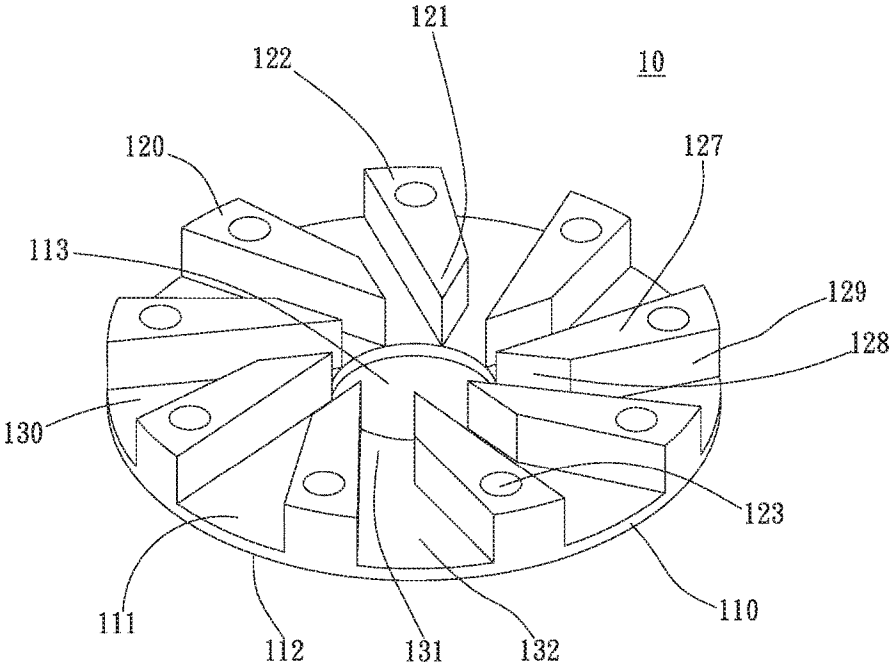
FIG. 1 is a perspective view of an impeller blade structure of the present invention according to a first embodiment thereof.

The present invention will now be described with some preferred embodiments thereof and by referring to the accompanying drawings. For the purpose of easy to understand, elements that are the same in the preferred embodiments are denoted by the same reference numerals.

Figure 2:
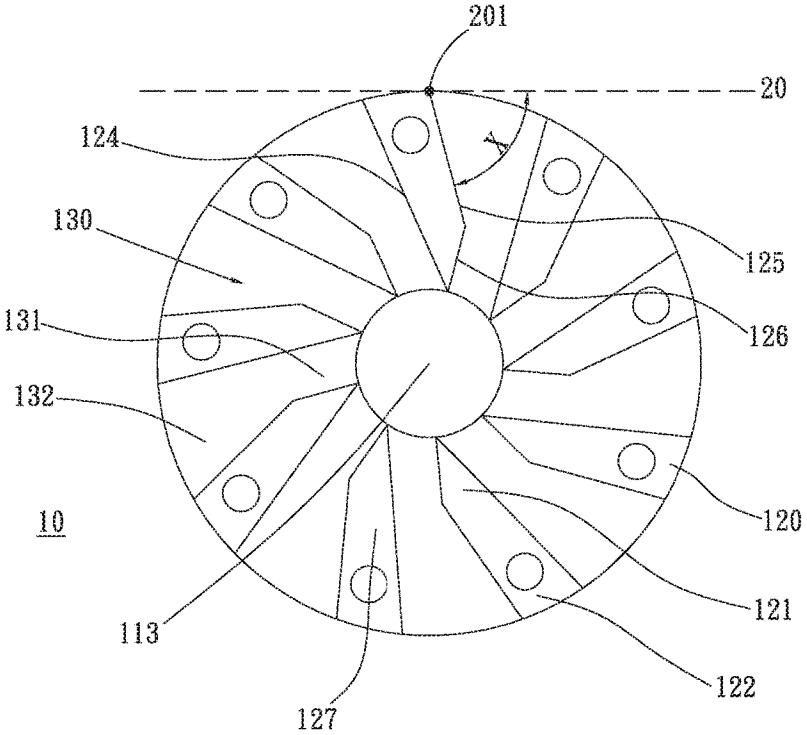
FIG. 2 is a top view of the impeller blade structure of FIG. 1.

Please refer to FIGS. 1 and 2, which are perspective and top views, respectively, of an impeller blade structure 10 of the present invention according to a first embodiment thereof. As shown, the impeller blade structure 10 includes a main body 110. In the first embodiment, the impeller blade structure 10 is configured for use in a pump chamber of a water cooling module (not shown). However, it is understood the first embodiment is only illustrative and not intended to limit the application of the impeller blade structure of the present invention. According to other operable embodiments, the impeller blade structure 10 can be used in other types of pump chambers. In brief, the description of the present invention herein is not intended to limit the applications and usages of the impeller blade structure 10 in any way.

The main body 110 has a first side 111 and an opposite second side 112, and is formed with a first through opening 113. In the illustrated first embodiment, the first side 111 is an upper side of the main body 110 and the second side 112 is a lower side of the main body 110. The first through opening 113 communicates the first side 111 and the second side 112 with one another. On the first side 111, there is a plurality of blades 120 angularly spaced around the first through opening 113. The blades 120 respectively include a first end 121 and an opposite second end 122. In the illustrated first embodiment, the first ends 121 of the blades 120 are located closer to and in contact with a peripheral edge of the first through opening 113.

The blades 120 respectively include a first coupling section 123. In the illustrated first embodiment, the first coupling sections 123 are located in the vicinity of the second ends 122 of the blades 120. However, it is understood the first embodiment is only illustrative. In other operable embodiments, the first coupling sections 123 can be otherwise provided on the blades 120 at other suitable locations. In the illustrated first embodiment, the first coupling sections 123 are respectively configured as a recess. The first coupling sections 123 are used to couple with a rotor structure (not shown in FIGS. 1 and 2), such that the entire impeller blade structure 10 is brought to rotate along with the rotor structure when the latter rotates.

The blades 120 respectively include a first edge 124, a second edge 125 and a third edge 126. The first and the second edge 124, 125 of each blade 120 are spaced from each other and are extended from the second end 122 toward the first through opening 113. The third edge 126 is located at the first end 121 and connected at two opposite ends to the first and the second edge 124, 125, so that the first, the second and the third edge 124, 125, 126 together define a top surface 127 of the blade 120. A radially outer end of the second edge 125 is located corresponding to a point 201 on a circumferential edge of the main body 110, and a virtual line 20 tangentially passes through the point 201.

An included angle X is defined between the virtual line 20 and the second edge 125. In the illustrated first embodiment, the included angle X is 75 degrees. The virtual line 20 is not a real line and is not a real element or structure of the impeller blade structure 10. Herein, the virtual line 20 is shown only to enable a user to conveniently measure the angle formed between the virtual line 20 and the second edge 125. In the illustrated first embodiment, the blades 120 are respectively a block-like body. An end surface of each block-like blade 120 adjoining the first end 121 and the third edge 126 provides a shorter flow-guiding surface 128. On the other hand, a side surface of each block-like blade 120 adjoining the second edge 125 and extended from the first end 121 to the second end 122 provides a longer flow-guiding surface 129.

Any two adjacent blades 120 together define between them a passage 130, which is communicable with the first through opening 113. A section of the passage 130 located adjacent to the third edge 126 of the blade 120 forms a narrowed passage 131. On the other hand, another section of the passage 130 located adjacent to the second edge 125 of the blade 120 forms a flared passage 132. The narrowed passage 131 has a width smaller than that of the flared passage 132. And, the width of the flared passage 132 is radially outward increased gradually. That is, the flared passage 132 has a bottom surface that is gradually widened from the first through opening 113 toward the circumferential edge of the main body 110. A cooling fluid (not shown) in the pump chamber of the water cooling module (not shown) can flow through the first through opening 113. Due to a centrifugal force produced by the impeller blade structure 10 when the same rotates, the cooling fluid passing through the first through opening 113 is driven to flow through the passages 130 defined between the adjacent blades 120.

When the impeller blade structure 10 rotates in the pump chamber of the water cooling module, the cooling fluid first passes through the first through opening 113 to flow into the narrowed passages 131 and then flows from the narrowed passages 131 into the flared passages 132. Since the flared passages 132 respectively have a width larger than that of the narrowed passages 131, the cooling fluid flowing through the narrowed passages 131 has a faster flowing speed and lower pressure compared to the cooling fluid flowing through the flared passages 132. That is, the flared passages 132 provide the effect of reducing the flowing speed and increasing the pressure of the cooling fluid flowing therethrough. With this effect, the cooling fluid can be exactly conveyed to a space outside the impeller blade structure 10. When the cooling fluid has been conveyed to the space outside the impeller blade structure 10, internal pressure of the pump chamber of the water cooling module is reduced at the same time, which creates a suction force at the first through opening 113 to suck the cooling fluid outside the first through opening 113 into the pump chamber again, so that the cooling fluid keeps circulating in the water cooling module.

Since the blades 120 are respectively configured as a block-like body, the second ends 122 of the blades 120 won't oscillate and no local thermal stress will occur on the blades 120 when the impeller blade structure 10 rotates. Therefore, the impeller blade structure 10 of the present invention can operate with reduced noise and have an extended service life.

Figure 3:
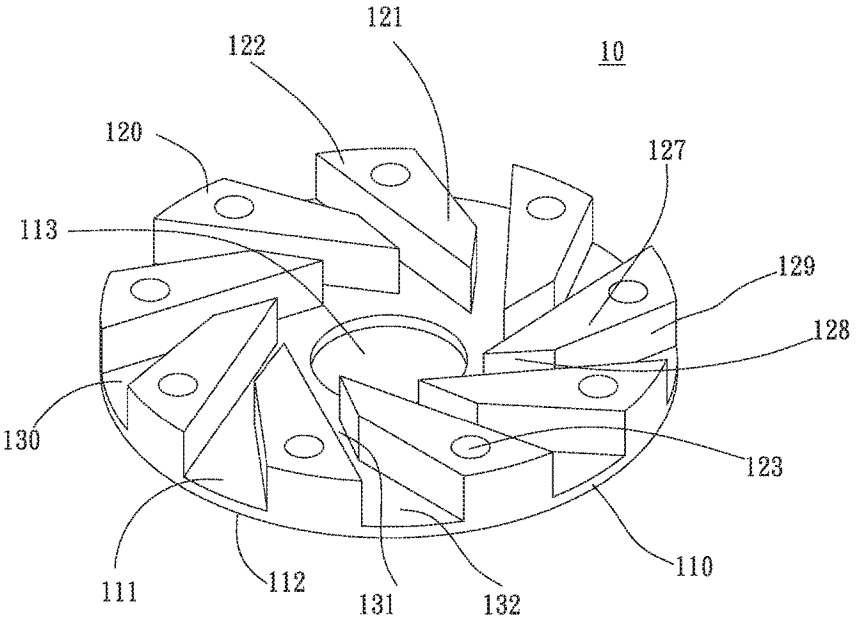
FIG. 3 is a perspective view of the impeller blade structure of the present invention according to a second embodiment thereof.
Figure 4:
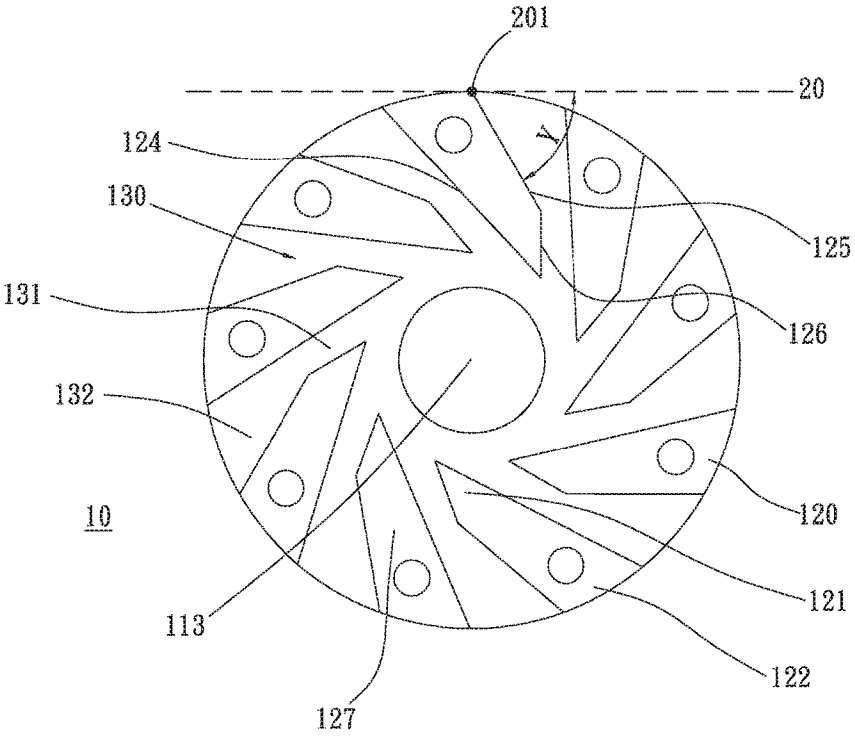
FIG. 4 is a top view of the impeller blade structure of FIG. 3.

FIGS. 3 and 4 are perspective and top views, respectively, of the impeller blade structure 10 of the present invention according to a second embodiment thereof. Please refer to FIGS. 3 and 4 along with FIGS. 1 and 2. As shown, the second embodiment is different from the first embodiment in that the first ends 121 of the blades 120 are not in contact with the peripheral edge of the first through opening 113 and that the virtual line 20 and the second edge 125 together define between them an included angle Y, which is 60 degrees. Since all other structural features of the second embodiment are similar to those of the first embodiment, they are not repeatedly described herein.

With the above arrangements, the impeller blade structure 10 of the present invention according to the second embodiment can provide the same good effect as the first embodiment.

Figure 5:
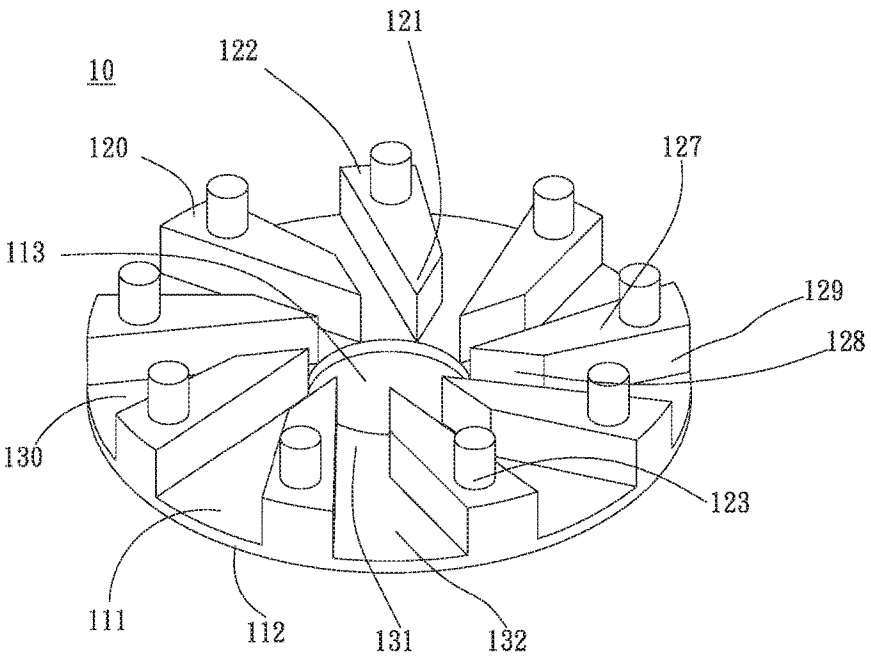
FIG. 5 is a perspective view of the impeller blade structure of the present invention according to a third embodiment thereof.
Figure 6:
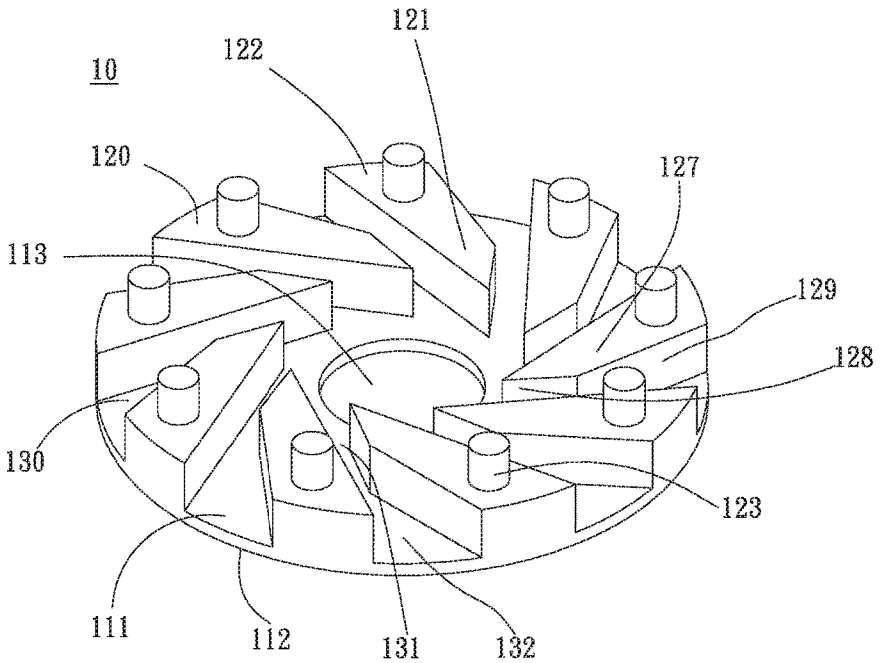
FIG. 6 is a perspective view of the impeller blade structure of the present invention according to a fourth embodiment thereof.

FIGS. 5 and 6 are perspective views of the impeller blade structure 10 of the present invention according to a third and a fourth embodiment thereof, respectively. Please refer to FIGS. 5 and 6 along with FIGS. 1 to 4. As shown, the third and the fourth embodiment are different from the first and the second embodiment, respectively, in that the first coupling sections 123 of the blades 120 are respectively configured as a boss. Since all other structural features of the third and the fourth embodiment are similar to those of the first and the second embodiment, respectively, they are not repeatedly described herein.

With the above arrangements, the impeller blade structure 10 of the present invention according to the third and fourth embodiments can provide the same good effect as the first and second embodiments.

Figure 7:
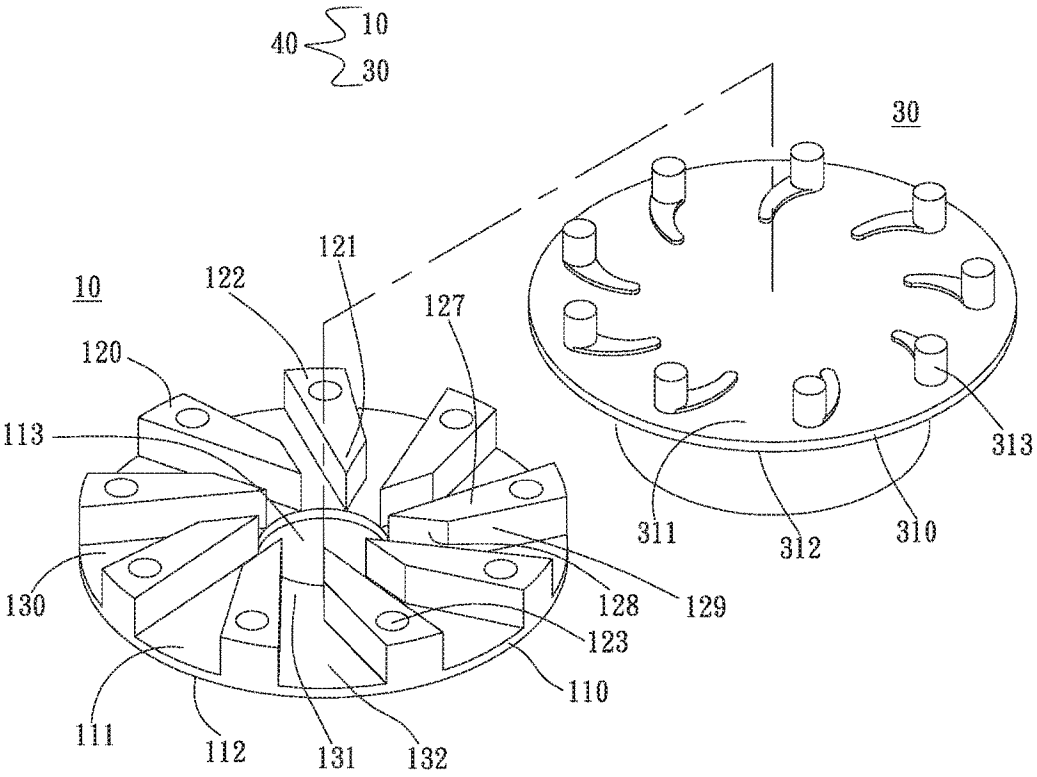
FIG. 7 is an exploded perspective view of a rotor assembly of the present invention according to a preferred embodiment thereof.
Figure 8:
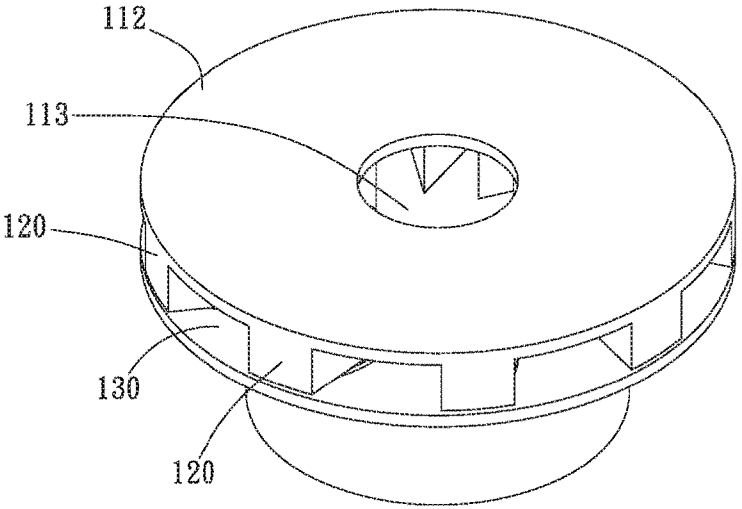
FIG. 8 is an assembled view of the rotor assembly of FIG. 7.
Figure 9:
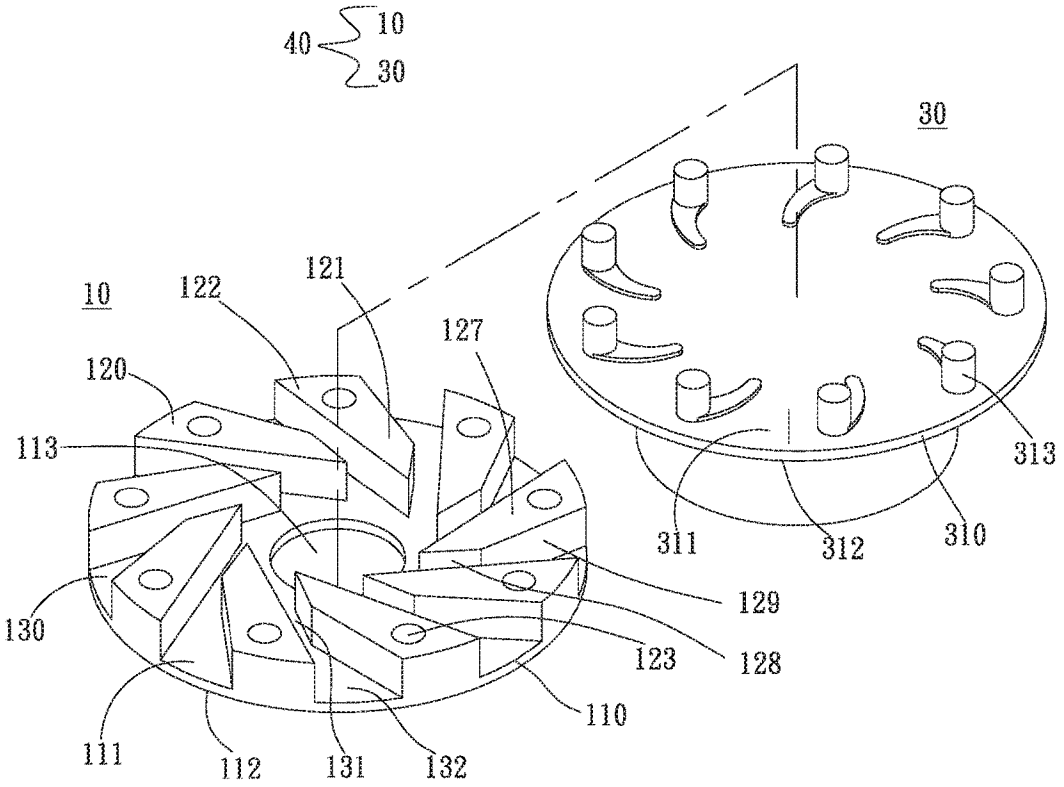
FIG. 9 is an exploded perspective view of a first alternative embodiment of the rotor assembly according to the preferred embodiment of the present invention.
Figure 10:
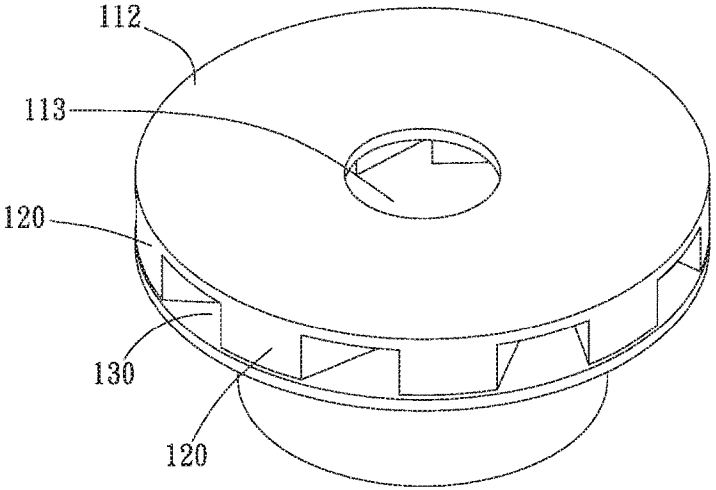
FIG. 10 is an assembled view of the rotor assembly of FIG. 9.

FIGS. 7 and 8 are exploded and assembled perspective views, respectively, of a rotor assembly 40 of the present invention according to a preferred embodiment thereof; and FIGS. 9 and 10 are exploded and assembled perspective views, respectively, of a first alternative embodiment of the rotor assembly 40 of FIGS. 7 and 8. Please refer to FIGS. 7, 8, 9 and 10 along with FIGS. 1 to 4. As shown, the rotor assembly 40 according to the preferred embodiment thereof includes an impeller blade structure 10 and a rotor structure 30. Like the first embodiment of the impeller blade structure 10 having been described with reference to FIGS. 1 and 2, the rotor assembly 40 according to the preferred embodiment thereof is configured for use in a pump chamber of a water cooling module (not shown). However, it is understood the preferred embodiment of the rotor assembly 40 is only illustrative and not intended to limit the application of the rotor assembly of the present invention. According to other operable embodiments, the rotor assembly 40 can be used in other types of pump chambers. In brief, the description of the present invention herein is not intended to limit the applications and usages of the rotor assembly 40 in any way.

Since the impeller blade structures 10 of the rotor assembly 40 shown in FIGS. 7 and 8 and in FIGS. 9 and 10 are structurally and functionally identical to those having been described with reference to FIGS. 1 and 2 and in FIGS. 3 and 4, respectively, they are not repeatedly described herein. The rotor structure 30 includes a body portion 310. In the illustrated preferred embodiment and first alternative embodiment of the rotor assembly 40, the rotor structure 30 is used with a stator assembly (not shown), so that an electromagnetic induction generated by the stator assembly drives the rotor structure 30 to rotate. The body portion 310 has a third side 311 and an opposite fourth side 312. The third side 311 of the body portion 310 is facing toward the first side 111 of the main body 110 of the impeller blade structure 10 when the rotor assembly 40 in an assembled state. On the third side 311, there is a plurality of angularly spaced second coupling sections 313, which are correspondingly engaged with the first coupling sections 123 on the main body 110 of the impeller blade structure 10.

Figure 11:
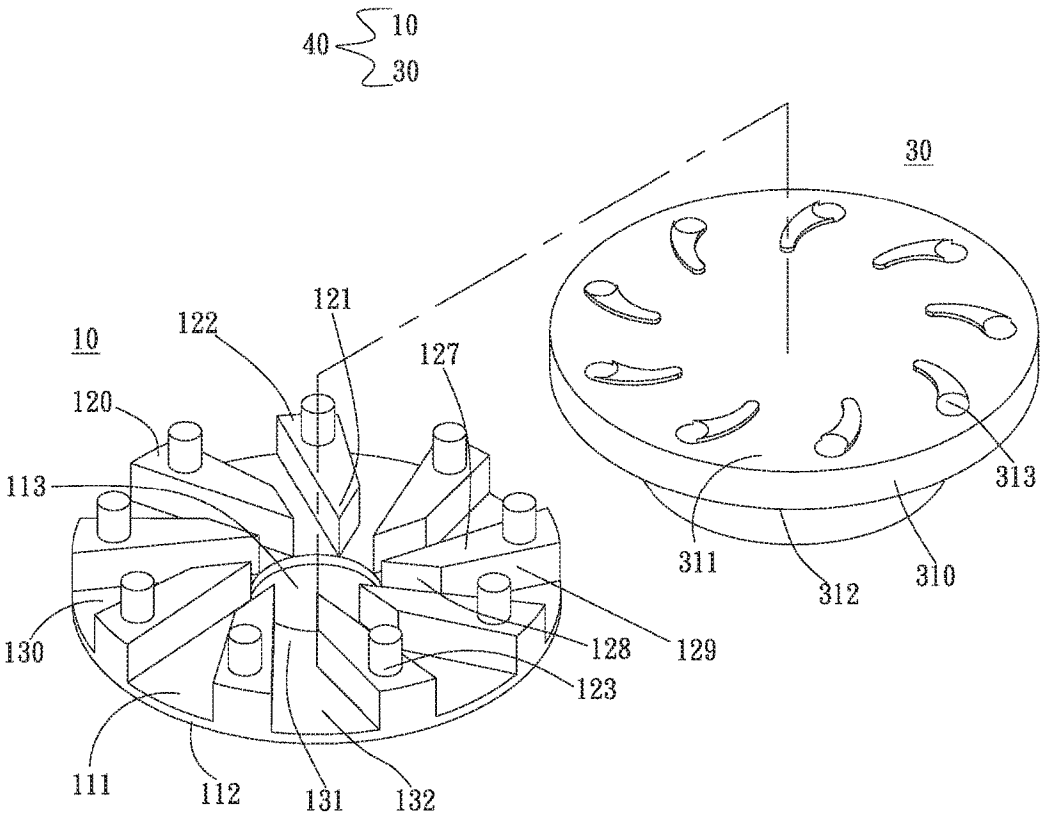
FIG. 11 is an exploded perspective view of a second alternative embodiment of the rotor assembly according to the preferred embodiment of the present invention.
Figure 12:
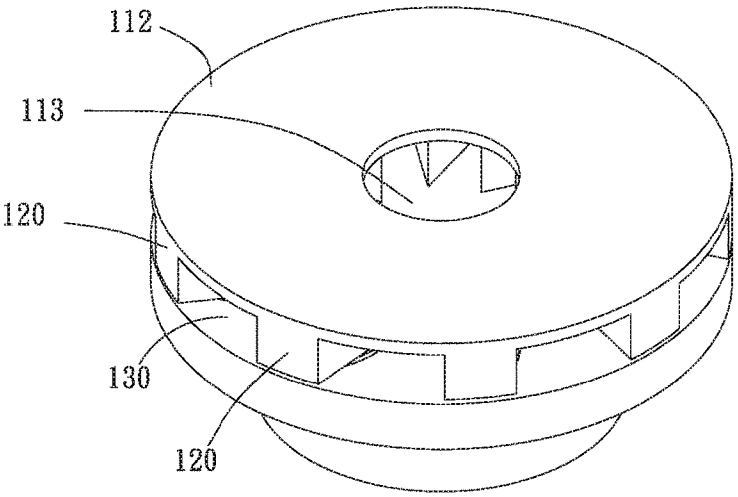
FIG. 12 is an assembled view of the rotor assembly of FIG. 11.
Figure 13:
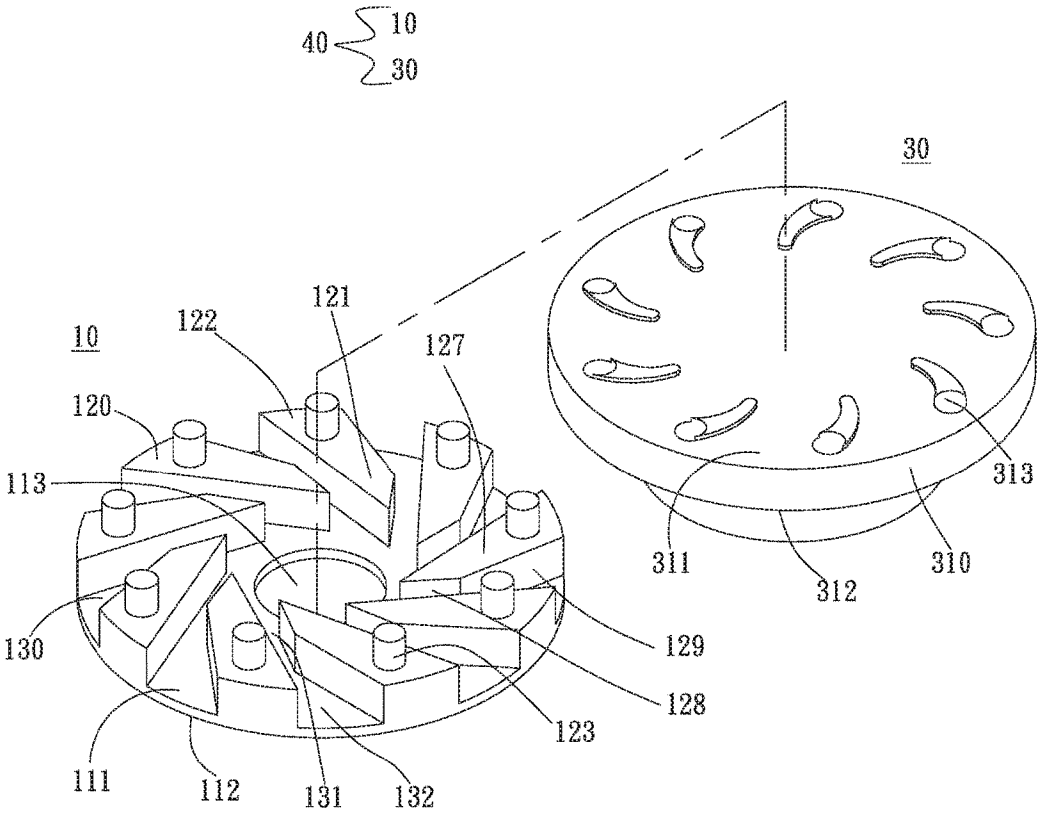
FIG. 13 is an exploded perspective view of a third alternative embodiment of the rotor assembly according to the preferred embodiment of the present invention.
Figure 14:
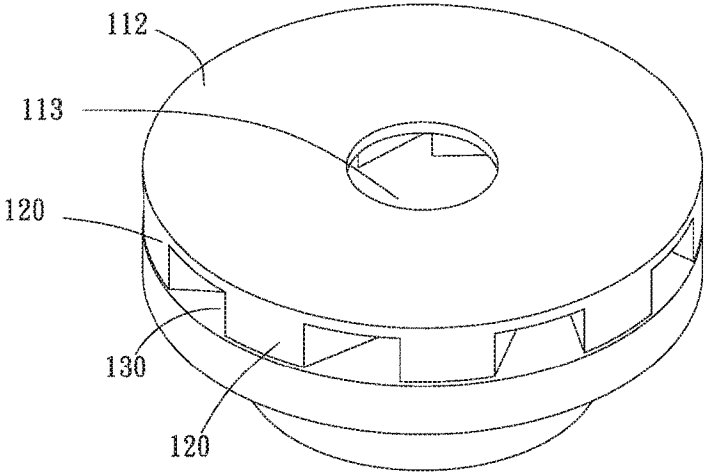
FIG. 14 is an assembled view of the rotor assembly of FIG. 13.

According to the first and second embodiments of the impeller blade structure 10, the first coupling sections 123 are located in the vicinity of the second ends 122 of the blades 120. Therefore, in the preferred embodiment and the first alternative embodiment of the rotor assembly 40, the second coupling sections 313 are located on the third side 311 at positions corresponding to the first coupling sections 123. Further, in the first and second embodiments of the impeller blade structure 10, since the first coupling sections 123 are respectively configured as a recess, the second coupling sections 313 in the preferred and the first alternative embodiment of the rotor assembly 40 are respectively configured as a boss corresponding to the recess, so that the first coupling sections 123 in the form of recesses and the second coupling sections 313 in the form of bosses are adapted to correspondingly engage with one another. Of course, in other operable embodiments, such as the second and the third alternative embodiment of the preferred embodiment of the rotor assembly 40 shown in FIGS. 11 and 12 and in FIGS. 13 and 14, respectively, the second coupling sections 313 can be recesses while the first coupling sections 123 can be corresponding bosses.

According to the present invention, the first coupling sections 123 and the second coupling sections 313 can be correspondingly engaged with one another by riveting, tight-fitting, bonding or magnetically attracting. It is understood, the present invention is not intended to limit in any way the manner in which the first and the second coupling sections 123, 313 are engaged with one another.

When the stator assembly (not shown) is supplied with an electric current, it interacts with the rotor assembly 40 to generate electromagnetic induction, which is transformed into mechanical kinetic energy to drive the rotor structure 30 to rotate. Since the rotor structure 30 and the impeller blade structure 10 are coupled to each other through engagement of the first coupling sections 123 with the second coupling sections 313, the rotating rotor structure 30 brings the impeller blade structure 10 to rotate along with it. The impeller blade structure 10 in rotating produces a centrifugal force, which enables the cooling fluid passing through the first through opening 113 to flow along the passages 130 between adjacent blades 120 and leave the impeller blade structure 10. Since the blades 120 of the rotor assembly 40 according to the preferred embodiment and the first and other alternative embodiments thereof are also respectively a block-like body, just like the blades 120 of the impeller blade structure 10 according to the first to the fourth embodiment thereof, the rotor assembly 40 of the present invention can also provide the same effect as the impeller blade structure 10.

In brief, with the impeller blade structure 10 and the rotor assembly 40 using same, the second ends 122 of the blades 120 won't oscillate and no local thermal stress will occur on the blades 120 when the rotor assembly 40 rotates. Therefore, the impeller blade structure 10 and the rotor assembly 40 of the present invention can operate with reduced noise and have extended service life.

The present invention has been described with some preferred embodiments thereof and it is understood that many changes and modifications in the described embodiments can be carried out without departing from the scope and the spirit of the invention that is intended to be limited only by the appended claims.

What is claimed is:

1. An impeller blade structure, comprising:

a main body having a first side and an opposite second side and being formed with a first through opening, which communicates the first side with the second side; the main body including a plurality of blades formed on the first side, and the blades respectively including a first end, which can be in contact with or not in contact with a peripheral edge of the first through opening, and a second end, which is located opposite to the first end; the blades further respectively including a first coupling section, and having a first edge, a second edge and a third edge; the first and the second edge of each blade being spaced from each other and extended from the second end toward the first through opening, and the third edge being located at the first end with two opposite ends connected to the first and the second edge, such that the first, the second and the third edge together define a top surface of the blade; a radially outer end of the second edge being located corresponding to a point on a circumferential edge of the main body, such that a virtual line tangentially passing through the point and the second edge together define an included angle between them; and any two adjacent blades together defining between them a passage, a section of each of the passages located adjacent to the third edge of a corresponding blade forming a narrowed passage, and another section of the passage located adjacent to the second edge of the corresponding blade forming a flared passage.

2. The impeller blade structure as claimed in claim 1, wherein the first ends of the blades are in contact with the peripheral edge of the first through opening, and the included angle defined between the virtual line and the second edge is 75 degrees.

3. The impeller blade structure as claimed in claim 1, wherein the first ends of the blades are not in contact with the peripheral edge of the first through opening, and the included angle defined between the virtual line and the second edge is 60 degrees.

4. The impeller blade structure as claimed in claim 1, wherein the passages are communicable with the first through opening.

5. The impeller blade structure as claimed in claim 1, wherein the blades are respectively a block-like body; an end surface of each of the block-like blades adjoining the first end and the third edge providing a shorter flow-guiding surface, and a side surface of each of the block-like blades adjoining the second edge and extended from the first end to the second end provides a longer flow-guiding surface.

6. The impeller blade structure as claimed in claim 1, wherein the first coupling sections are located in the vicinity of the second ends of the blades.

7. The impeller blade structure as claimed in claim 1, wherein the first coupling sections are respectively in a form selected from the group consisting of a recess and a boss.

8. A rotor assembly, comprising:

an impeller blade structure including a main body having a first side and an opposite second side and being formed with a first through opening, which communicates the first side with the second side; the main body including a plurality of blades formed on the first side, and the blades respectively including a first end, which can be in contact with or not in contact with a peripheral edge of the first through opening, and a second end, which is located opposite to the first end; the blades further respectively including a first coupling section, and having a first edge, a second edge and a third edge; the first and the second edge of each blade being spaced from each other and extended from the second end toward the first through opening, and the third edge being located at the first end with two opposite ends connected to the first and the second edge, such that the first, the second and the third edge together define a top surface of the blade; a radially outer end of the second edge being located corresponding to a point on a circumferential edge of the main body, such that a virtual line tangentially passing through the point and the second edge together define an included angle between them; and any two adjacent blades together defining between them a passage, a section of each of the passages located adjacent to the third edge of a corresponding blade forming a narrowed passage, and another section of the passage located adjacent to the second edge of the corresponding blade forming a flared passage; and a rotor structure including a body portion having a third side and an opposite fourth side; and the third side facing toward the first side of the main body of the impeller blade structure and having a plurality of second coupling sections angularly spaced thereon to correspondingly engage with the first coupling sections.

9. The rotor assembly as claimed in claim 8, wherein the first ends of the blades are in contact with the peripheral edge of the first through opening, and the included angle defined between the virtual line and the second edge is 75 degrees.

10. The rotor assembly as claimed in claim 8, wherein the first ends of the blades are not in contact with the peripheral edge of the first through opening, and the included angle defined between the virtual line and the second edge is 60 degrees.

11. The rotor assembly as claimed in claim 8, wherein the passages are communicable with the first through opening.

12. The rotor assembly as claimed in claim 8, wherein the blades are respectively a block-like body; an end surface of each of the block-like blades adjoining the first end and the third edge providing a shorter flow-guiding surface, and a side surface of each of the block-like blades adjoining the second edge and extended from the first end to the second end provides a longer flow-guiding surface.

13. The rotor assembly as claimed in claim 8, wherein the first coupling sections are located in the vicinity of the second ends of the blades of the impeller blade structure and the second coupling sections are located on the third side of the body portion of the rotor structure at positions corresponding to the first coupling sections.

14. The rotor assembly as claimed in claim 13, wherein the first coupling sections are respectively in the form of a recess and the second coupling sections are respectively in the form of a boss; and the recesses and the bosses being correspondingly engaged with one another.

15. The rotor assembly as claimed in claim 13, wherein the first coupling sections are respectively in the form of a boss and the second coupling sections are respectively in the form of a recess; and the bosses and the recesses being correspondingly engaged with one another.

16. The rotor assembly as claimed in claim 8, wherein the first coupling sections and the second coupling sections are correspondingly engaged with one another in a way selected from the group consisting of riveting, tight-fitting, bonding and magnetically attracting.

* * * * *